United States Patent [19]

Ochmann et al.

[11] Patent Number: 4,796,286

[45] Date of Patent: Jan. 3, 1989

[54] X-RAY GENERATOR DOSE FLUCTUATION SUPPRESSION

[75] Inventors: Rudolf W. Ochmann; Peter Stege; Robert H. Zimmermann, all of Hamburg, Fed. Rep. of Germany

[73] Assignee: U.S. Philips Corporation, New York, N.Y.

[21] Appl. No.: 66,913

[22] Filed: Jun. 25, 1987

[30] Foreign Application Priority Data

Jun. 28, 1986 [DE] Fed. Rep. of Germany ..... 3621803

[51] Int. Cl.[4] ..... H05G 1/44

[52] U.S. Cl. ..... 378/108; 378/110; 378/112; 377/16

[58] Field of Search ..... 378/101, 108, 109, 110, 378/111, 112; 377/16

[56] References Cited

U.S. PATENT DOCUMENTS 4,119,856 10/1978 Franke ..... 378/111 X

*Primary Examiner*—Eugene R. LaRoche
*Assistant Examiner*—David Mis
*Attorney, Agent, or Firm*—Jack E. Haken

[57] ABSTRACT

In X-ray generators comprising a converter for generating the high-voltage for an X-ray tube, substantial dose fluctuations are liable to occur from one exposure to another of series involving a fixed exposure time due to supply voltage fluctuations or fluctuations in the object absorption. These dose fluctuations are more pronounced as the exposure time is shorter and as the converter frequency is lower. These fluctuations are reduced by terminating a series of exposures each time after the same number of converter alternations when the deviation between the actual value and the reference value of the dose or the dose rate is smaller than a predetermined value.

5 Claims, 2 Drawing Sheets

X-RAY GENERATOR DOSE FLUCTUATION SUPPRESSION

The invention relates to an X-ray generator, comprising a converter and means for the dose-controlled or time-controlled switching-off of the high voltage for an X-ray tube.

An X-ray generator of this kind is known essentially from German Pat. Nos. 29 08 767 and 30 46 413. When such an X-ray generator is used for making series of exposures of an object, substantial dose fluctuations can occur, even in the case of dose control or dose rate control, notably when the exposure times are comparatively short and the voltage ripple is comparatively high. This leads to image brightness fluctuations which are annoying, notably when the exposures of the series are continuously observed as in the case of cineradiography.

It is the object of the invention to construct an X-ray generator of the kind set forth so that dose fluctuations behind the object during a series of exposures are suppressed to a high degree.

This object is achieved in accordance with the invention in that there is provided a counting device which counts the number of converter alternations during a first exposure and which terminates the subsequent exposures of a series when the same number of converter alternations is reached as during the first exposure.

The invention is based on the following considerations: an X-ray generator comprising one or more converters which generate an a.c. voltage from a d.c. voltage by means of switching elements (for example, thyristors) which remain conductive after triggering until the polarity of the current flowing therethrough is reversed, can be switched off only after an integer number of alternations of this a.c. voltage. Depending on the magnitude of the exposure parameters, during the individual exposures of a series the instant of switching off may be situated briefly before or briefly after the beginning of a converter alternation. Thus, the effective exposure time varies by the duration of a converter alternation, resulting in a corresponding dose fluctuation which will be more pronounced as the number of converter alternations per exposure is smaller.

When the end of the exposure is always determined by the counting device, the next exposure will be terminated each time after the same number of converter alternations as the preceding exposure. Therefore, the dose fluctuations caused by a varying number of converter alternations per exposure cannot occur.

The term "exposure" is to be broadly interpreted; herein, the formation of any X-ray image by switching an X-ray generator on and off is referred to as exposure, hence also, for example pulsed fluoroscopy.

A further version in accordance with the invention, includes a timer for terminating an exposure after a presettable time interval, the X-ray generator being controlled as a function of the difference between the reference value and the actual value of the dose or the dose rate so that the exposure is terminated by the counting device when the difference is below a threshold value and is terminated by the timer when the difference exceeds the threshold value.

In this embodiment, suitable for use, for example for cineradiography, an exposure is terminated by the timer (i.e. after a defined period of time) when a comparatively large control deviation occurs, while it is terminated by the counting device in the case of small control deviations, i.e. after a defined number of converter alternations.

This embodiment is suitable for all exposure methods where an exposure is customarily terminated after expiration of a defined period of time, for example in cineradiography. However, the invention can in principle be used also for exposure methods where the individual exposures are terminated by an automatic exposure device when a predetermined switch-off dose has been reached, because the number of converter alternations could again fluctuate from one exposure to another in such a case. The invention, however, can also be used for exposure methods where the exposure for a series is determined once by a test exposure and where all subsequent exposures of the series are carried out with the same exposure parameters. In that case mains voltage fluctuations which are compensated for by variation of the converter frequency will hardly have any effect on the exposure dose.

In a further version of the described embodiment in accordance with the invention the adjusting members are controlled so that, when the difference between the reference value and the actual value is below the threshold value, essentially only the adjusting member for the tube voltage is activated. As a result, uniformly exposed images can be obtained despite an X-ray absorption which varies from one exposure to another.

An embodiment in accordance with the invention will be described in detail hereinafter with reference to the drawing.

Therein:

Figure 1:
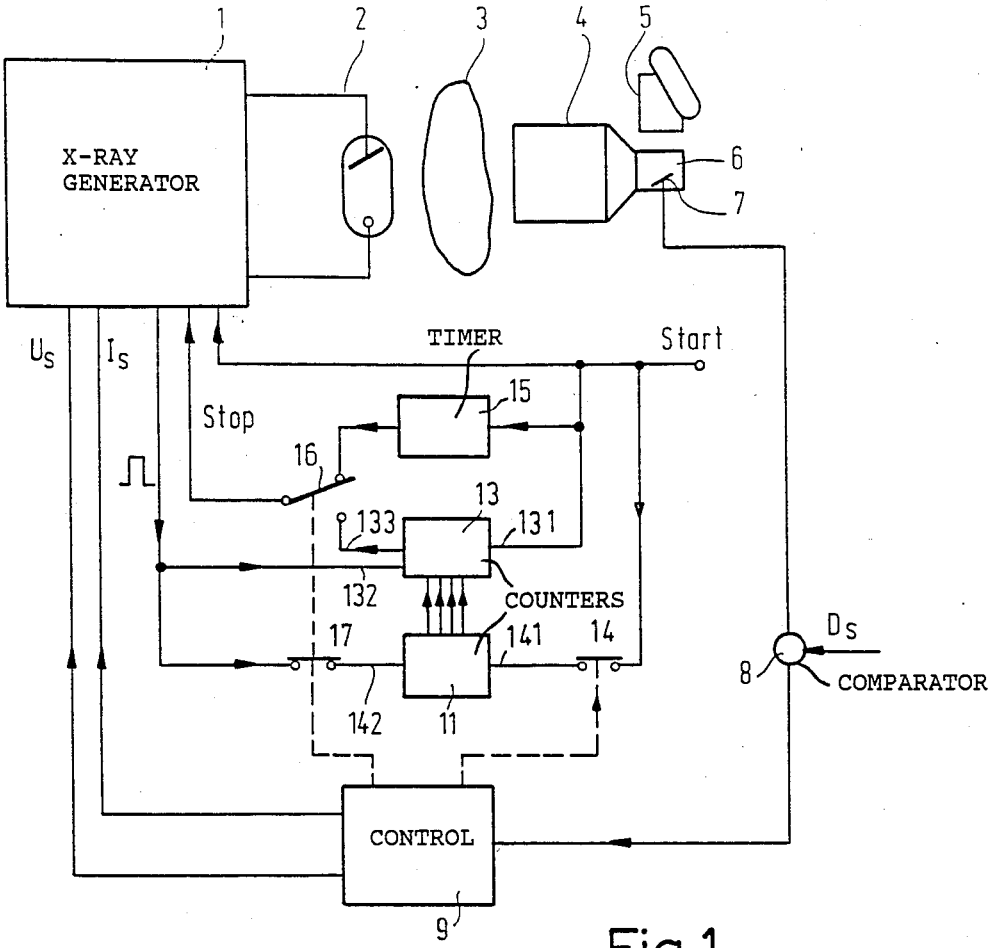
FIG. 1 shows a circuit diagram of an X-ray generator in accordance with the invention.

The reference numeral 1 in FIG. 1 denotes an X-ray generator which generates the voltage and the current for an X-ray tube 2 which irradiates an object 3 whose X-ray shadow image is converted into a visible image by an image intensifier 4. Via an image distributor 6, the visible image is applied on the one hand to a cine camera 5 and on the other hand to a dose measuring member or dose rate measuring member 7 whose measurement value is compared with a predetermined reference value Ds of the dose or the dose rate in a comparator 8.

On the basis of the difference between the reference value and the actual value, a control unit 9 determines reference values for the tube current $I_s$ and the tube voltage $U_s$ which act on adjusting members included in the X-ray generator 1.

Figure 2:
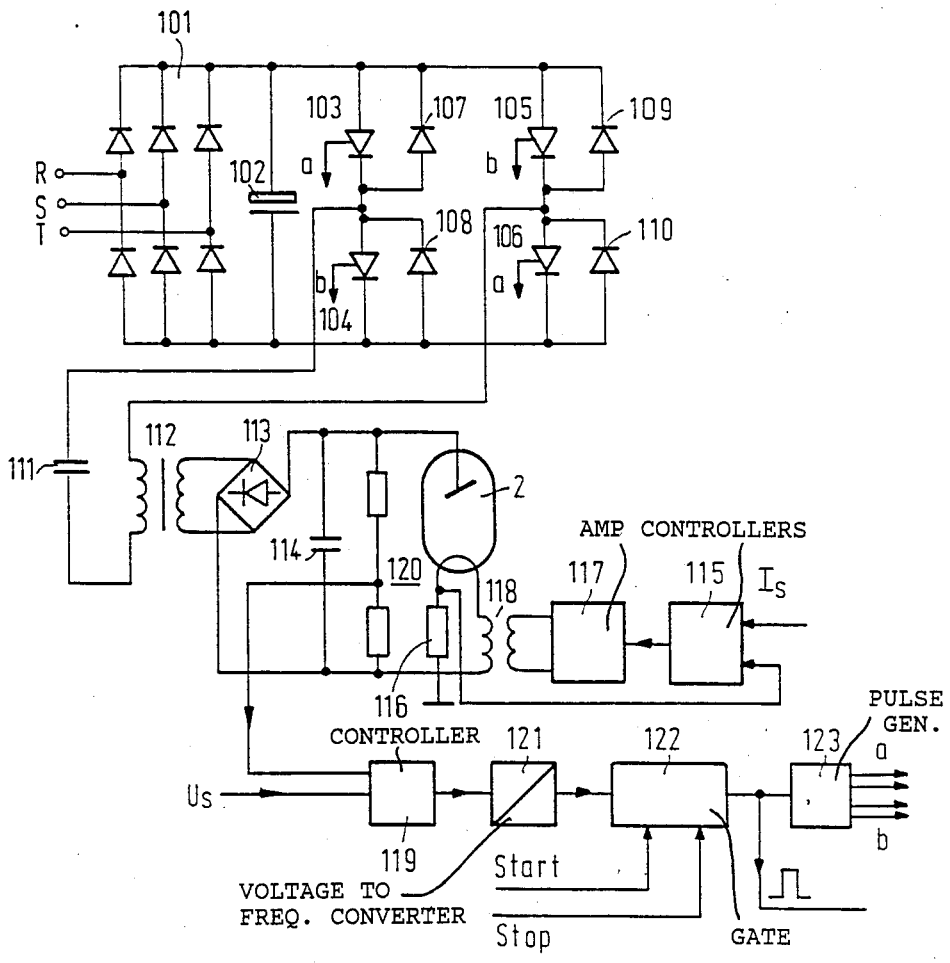
FIG. 2 shows some details of such a generator.

As appears from FIG. 2, a d.c. voltage is generated in the X-ray generator 1 by means of a three-phase rectifier bridge 101 which is connected to a three-phase mains R, S, T, said d.c. voltage appearing across a capacitor 102 which is connected to the outputs of said bridge. This d.c. voltage powers a series resonance converter. As a full-wave bridge circuit the converter comprises two parallel-connected branches, each of which comprises two series-connected thyristors 103, 104 and 105, 106, respectively, which are connected in the same forward direction. A flywheel diode 107, 108 and 109, 110, respectively, is connected parallel to each thyristor. The thyristors 103 and 106 are simultaneously triggered by trigger pulses applied to their trigger electrodes a in an alternating fashion with respect to the thyristors 105 and 104 which are also simultaneously triggered by trigger pulses applied to their trigger electrodes b. Thus, one of the thyristors in a bridge branch is always conductive.

Between the junctions of the thyristors 103 and 104 on the one side and 105 and 106 on the other side there is connected a series connection of a capacitor 111 and an inductance which is formed by the primary winding of a high-voltage transformer 112 whose secondary side is connected to a rectifier 113 whose output voltage is smoothed by means of a capacitor 114 and applied to the X-ray tube 2. In order to vary the voltage on the X-ray tube (with a constant tube current), slight variation of the frequency of the trigger pulses applied to the thyristors 103 . . . 106 will be necessary. However, in order to maintain a predetermined tube voltage when the tube current is varied, the trigger frequency must be varied substantially in proportion to the tube current.

The X-ray generator comprises two control circuits for adjusting the tube current and the tube voltage. The tube current control circuit comprises a controller 115 in which the tube current reference value Is supplied by the control device 9 is compared with the voltage drop which corresponds to the actual value of the tube current and which is derived from a resistor 116 in the cathode supply lead of the X-ray tube 2. The control value formed by the controller 115 is applied, via an amplifier 117 and a filament current transformer 118, to the filament of the X-ray tube 2, the tube current being varied as the filament current varies.

The tube voltage control circuit comprises a controller 119 (for example, a PID controller) whose input value is formed by the difference between the tube voltage reference value Us supplied by the control unit 9 and the actual value of the tube voltage which is derived from a voltage divider 120 connected parallel to the X-ray tube 2. The output value of the controller 119 is applied to a voltage/frequency converter 121 whose output frequency is the trigger frequency for the thyristors 103 . . . 106. A pulse generator 123, connected to the converter 121 via a gate circuit 122, forms the trigger pulses for the trigger electrodes a and b of the thyristors 103 . . . 106 therefrom. The gate circuit 122 is open, i.e. trigger pulses are generated, when a start signal is present on a lead "Start" and when no stop signal is present on a lead "Stop". In all other cases, the gate circuit is blocked so that no further trigger pulses can be formed.

The X-ray generator in accordance with the invention comprises a counting device which includes two counters 11 and 13. The data outputs of the counter 11 are connected to the data inputs of the counter 13, so that in response to a signal on the set input 131 of the counter 13 the count of the counter 11 is loaded into the counter 13. This takes place whenever a start signal appears on the lead "Start". The counting input 142 of the counter 11 is connected, via a switch 17 which is controlled by the control unit 9, to the output of the gate circuit 122 which is also connected (directly) to the counting input 132 of the second counter 13. When the switch 17 is closed, both counters thus count the trigger pulses applied to the thyristors of the converter, and hence the alternations produced by the converter. The counter 11 is connected as a count-up counter, but the counter 13 acts as a count-down counter. The reset input 141 of the counter 11 is connected, via a switch 14 which can also be controlled by the control device 9, to the lead "Start", so that it is reset to zero whenever a start signal appears on the lead "Start", i.e. each time at the beginning of an exposure.

The start signal also starts a timer 15 whose output is connected, via a switch 16, to the lead "Stop" via which the exposure is terminated. The other connection of the switch 16 is connnected to an output 133 of the counter 13 on which a signal for terminating the exposure appears each time when the counter reaches the position zero.

At the beginning of a series of exposures, the switches 17 and 14 are closed and the switch 16 is connected to the output of the timer 15. The termination of the exposure is thus predetermined by the timer 15, so that the distance in time between the start signal and the stop signal is exactly defined and the same for all exposures of the series. When the measured dose deviates from the predetermined reference dose Ds, the control unit 9 supplies reference values for the tube current and the tube voltage for the next exposure, said reference values being determined in accordance with a suitable control algorithm so that the difference between reference value and actual value is reduced for the next exposure. For each exposure the start signal on the lead "Start" transfers the count of the counter 11 to the counter 13 and resets the counter 11 to zero; the counter 11 then counts the trigger pulses or the converter alternations during an exposure.

Generally, after a few exposures the deviation between the actual value and the reference value of the dose for an exposure has dropped below a presettable threshold value which may amount to, for example, 30% of the reference value. In that case the control unit switches over the switching device 17, 14, 16, so that the switches 17 and 14 are opened and the switch 16 is connected to the output 133 of the counter 13. At the beginning of the next exposure, the count reached by the counter 11 during the preceding exposure is loaded into the counter 13 which subsequently counts down in response to the trigger pulses generated during the exposure. When the count zero is reached, i.e. when the counter 13 has counted exactly as many trigger pulses as during the preceding exposure, a stop signal is formed on the output 133 of the counter 13, so that the exposure is terminated. Because the count of the counter 11 is no longer changed in this state of operation, it actually acts as a memory whose contents is loaded into the counter 13 each time at the beginning of the exposure, so that all further exposures are also terminated after the same number of trigger pulses or converter alternations. This continues for as long as the deviation remains below said threshold value. When the deviation becomes larger, the switches 17 and 14 and the switch 16 are again set to the position shown in FIG. 1, so that the further operation of the X-ray generator is controlled solely by the timer.

The control unit 9 is constructed so that in the operating condition where the counter 13 determines the end of exposure in that each exposure is terminated after the same number of converter alternations dose deviations are reduced in the next exposure in that the tube voltage reference value Us given for this next exposure is varied whilst the reference value $I_s$ for the tube current essentially remains the same. This is beacuse a variation of the tube current reference value (for a constant tube voltage) would necessitate a variation of the trigger frequency substantially in proportion to the tube current as has already been described. The exposure time would then vary in the opposite sense to the same extent, which would mean that the product of exposure time and tube current, being decisive for the dose, would not change or would change only in an unpredictable manner. Such a behaviour, however, can lead to instabilities in a control circuit. Moreover, the strong variation of the exposure time could lead to undesirable results in the case of exposures using cinecameras.

Therefore, the control unit 9 is constructed so that in the described operating condition a variation of the tube current reference value takes place only in conjunction with an inversely proportional variation of the tube voltage reference value and only in the borderline case where the product of tube current and tube voltage still corresponds to the tube power still permissible for the tube 2. This is because, if the actual dose were too low in this borderline case, an increase of the tube voltage in order to increase the dose for the next exposure would cause overloading of the X-ray tube 2 if at the same time the tube current were not varied in the opposite sense so as not to exceed the permissible tube power. Despite the reduction of the current, the dose would then be increased for the next exposure, because the variation of the tube voltage is known to have a much greater effect on the dose than the variation of the tube current. Thus, the tube current and the trigger frequency would then change in the opposite sense with respect to the tube voltage, causing a variation of the exposure time in the same sense as the tube voltage, so that the dose would be additionally influenced in the desired sense.

Figure 3:
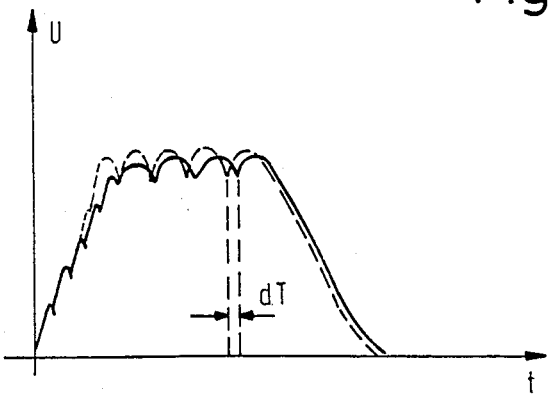
FIG. 3 shows the variation in time of the tube voltage during an X-ray exposure.

As has already been stated, in the operating condition in which the counter 13 determines the end of exposure, a variation of the dose or the dose rate is generally realized only by variation of the tube voltage reference value Us, the tube current remaining constant. The variation in time of the tube voltage is shown in FIG. 3, i.e. by a solid line for a first tube voltage and by a broken line for a second tube voltage which is higher than the first tube voltage. At the beginning of each exposure, the trigger frequency is comparatively high, so that the tube voltage reaches its reference value comparatively quickly. In the case of a low reference value, however, the trigger frequency decreases sooner than in the case of a higher reference value, so that the duration of an exposure involving a lower tube voltage is slightly longer (by the period dT) than the duration of an exposure using a higher tube voltage. However, this variation is so small that its opposite effect on the dose in order to vary the tube voltage is hardly noticeable.

What is claimed is:

1. In an X-ray generator, comprising a converter for alternating voltage and means for dose-controlled or time-controlled switching-off of the high voltage for an X-ray tube, the improvement comprising counting means which count converter alternations during a first exposure and which terminate subsequent exposures of a series when a same number of converter alternations is reached as were counted during the first exposure.

2. An improved X-ray generator as claimed in claim 1, comprising a control circuit for dose or dose rate, which includes timer means for terminating an exposure after a presettable time interval so that the X-ray generator is controlled as a function of the difference between a reference value and an actual value of the dose or the dose rate so that exposures are terminated by the counting means when the difference is below a threshold value and are terminated by the timer means when the difference exceeds the threshold value.

3. An improved X-ray generator as claimed in claim 2, further comprising adjusting means which adjust voltage to a connected X-ray tube and adjusting means which adjust current through the connected X-ray tube as a function of the difference between the reference value and the actual value of dose or dose rate, wherein the adjusting means are controlled so that, when the difference between the reference value and the actual value is below the threshold value, essentially only the adjusting means which adjust voltage are activated.

4. An improved X-ray generator as claimed in any one of the preceding claims, wherein the counting means comprise a memory in which a number of converter alternations for an exposure is stored and a first counter connected to the memory which terminates an exposure after having counted the stored number of alternations.

5. An improved X-ray generator as claimed in claim 4, wherein the memory is a second counter which determines the number of converter alternations during the first exposure and whose count is loaded into the first counter at the beginning of a subsequent exposure.

* * * * *